US011855336B2

(12) United States Patent
Zimmerman

(10) Patent No.: US 11,855,336 B2
(45) Date of Patent: Dec. 26, 2023

(54) METROCELL ANTENNAS CONFIGURED FOR MOUNTING AROUND UTILITY POLES

(71) Applicant: CommScope Technologies LLC, Hickory, NC (US)

(72) Inventor: Martin L. Zimmerman, Chicago, IL (US)

(73) Assignee: CommScope Technologies LLC, Claremont, NC (US)

( * ) Notice: Subject to any disclaimer, the term of this patent is extended or adjusted under 35 U.S.C. 154(b) by 0 days.

(21) Appl. No.: 18/046,230

(22) Filed: Oct. 13, 2022

(65) Prior Publication Data

US 2023/0064015 A1 Mar. 2, 2023

Related U.S. Application Data

(62) Division of application No. 17/275,734, filed as application No. PCT/US2019/050562 on Sep. 11, 2019, now Pat. No. 11,515,623.

(Continued)

(51) Int. Cl.
*H01Q 1/24* (2006.01)
*H01Q 1/12* (2006.01)

(Continued)

(52) U.S. Cl.
CPC ..... *H01Q 1/246* (2013.01); *H01Q 1/12* (2013.01); *H01Q 19/10* (2013.01); *H01Q 21/08* (2013.01)

(58) Field of Classification Search
CPC ..... H01Q 1/246; H01Q 19/10; H01Q 21/06; H01Q 21/08; H01Q 21/205; H01Q 21/24; H01Q 21/26
See application file for complete search history.

(56) References Cited

U.S. PATENT DOCUMENTS 5,995,063 A * 11/1999 Somoza ..... H01Q 1/12 343/890
6,999,042 B2 * 2/2006 Dearnley ..... H01Q 1/1242 343/890

(Continued)

FOREIGN PATENT DOCUMENTS

KR 20060041167 A 5/2006
KR 20180088075 A 8/2018

(Continued)

OTHER PUBLICATIONS

Extended European Search Report corresponding to European Patent Application No. 19863232.5 (9 pages) (dated May 23, 2022).

(Continued)

*Primary Examiner* — Jason Crawford
(74) *Attorney, Agent, or Firm* — Myers Bigel, P.A.

(57) ABSTRACT

A metrocell antenna includes a plurality of linear arrays of first frequency band radiating elements, a first enclosure that includes a first of the linear arrays of first frequency band radiating elements mounted therein, a second enclosure that includes a second of the linear arrays of first frequency band radiating elements mounted therein, a third of the linear arrays of first frequency band radiating elements mounted within one of the first and second enclosures, a first RF port that is mounted through the first enclosure and a first blind-mate connector that provides an electrical connection between the first enclosure and the second of the linear arrays of first frequency band radiating elements that is mounted in the second enclosure.

25 Claims, 12 Drawing Sheets

Related U.S. Application Data

(60) Provisional application No. 62/733,742, filed on Sep. 20, 2018.

(51) Int. Cl.
*H01Q 19/10* (2006.01)
*H01Q 21/08* (2006.01)

(56) References Cited

U.S. PATENT DOCUMENTS

| | | | | |
|---|---|---|---|---|
| 7,907,096 | B2 | 3/2011 | Timofeev et al. | |
| 9,219,461 | B2 | 12/2015 | Zimmerman | |
| 9,325,061 | B2 | 4/2016 | Rucki et al. | |
| 9,433,034 | B2 * | 8/2016 | Hendrix | H01Q 1/36 |
| 10,199,712 | B1 * | 2/2019 | Boyle | F21S 8/085 |
| 10,347,979 | B1 * | 7/2019 | Boyle | H01Q 1/1228 |
| 10,530,440 | B2 | 1/2020 | Bisiules et al. | |
| 10,587,034 | B2 | 3/2020 | Zimmerman et al. | |
| 11,381,032 | B2 | 7/2022 | Pepe et al. | |
| 11,515,623 | B2 * | 11/2022 | Zimmerman | H01Q 1/12 |
| 2004/0174317 | A1 | 9/2004 | Dearnley et al. | |
| 2005/0030250 | A1 * | 2/2005 | Gottl | H01Q 1/42 343/878 |
| 2012/0280881 | A1 * | 11/2012 | Beausang | H01Q 15/14 343/837 |
| 2014/0315408 | A1 * | 10/2014 | Colapietro | H01Q 1/246 439/247 |
| 2015/0013261 | A1 * | 1/2015 | Kolokotronis | B23P 15/00 52/651.07 |
| 2015/0057047 | A1 * | 2/2015 | Hendrix | H04B 1/40 455/562.1 |
| 2015/0156642 | A1 * | 6/2015 | Sobczak | H01Q 9/0435 455/562.1 |
| 2015/0264742 | A1 | 9/2015 | Merola | |
| 2016/0007488 | A1 * | 1/2016 | Neustadt | H01Q 1/246 174/541 |
| 2016/0099745 | A1 * | 4/2016 | Ho | H04B 3/03 455/562.1 |
| 2016/0104969 | A1 | 4/2016 | An et al. | |
| 2016/0119796 | A1 * | 4/2016 | Ho | H04B 1/40 370/328 |
| 2016/0261030 | A1 * | 9/2016 | Kim | H01Q 1/1264 |
| 2016/0329630 | A1 * | 11/2016 | Mustajarvi | H01Q 1/246 |
| 2016/0352042 | A1 * | 12/2016 | Wankoff | H01R 13/6315 |
| 2016/0365618 | A1 * | 12/2016 | Kim | H01Q 1/1242 |
| 2016/0365624 | A1 * | 12/2016 | Maley | H01Q 21/205 |
| 2017/0214133 | A1 * | 7/2017 | Orem | H01Q 1/1207 |
| 2018/0026327 | A1 * | 1/2018 | Hendrix | H01Q 1/1228 455/562.1 |
| 2018/0227775 | A1 * | 8/2018 | Bisiules | H01Q 5/48 |
| 2018/0254545 | A1 * | 9/2018 | Hendrix | H01Q 1/02 |
| 2018/0277923 | A1 * | 9/2018 | Kang | H01Q 1/246 |
| 2019/0103660 | A1 * | 4/2019 | Zimmerman | H01Q 19/06 |
| 2019/0348752 | A1 | 11/2019 | Kim et al. | |
| 2020/0036087 | A1 * | 1/2020 | Maley | H01Q 1/1228 |
| 2021/0328337 | A1 * | 10/2021 | Gienger | H01Q 1/44 |
| 2022/0037768 | A1 * | 2/2022 | Zimmerman | H01Q 1/246 |
| 2023/0064015 | A1 * | 3/2023 | Zimmerman | H01Q 1/12 |

FOREIGN PATENT DOCUMENTS

| | | | |
|---|---|---|---|
| WO | 2015023364 | A1 | 2/2015 |
| WO | 2016200436 | A1 | 12/2016 |
| WO | 2018074899 | A1 | 4/2018 |

OTHER PUBLICATIONS

International Search Report and the Written Opinion of the International Searching Authority corresponding to International Patent Application No. PCT/US2019/050562 (14 pages) (dated Jan. 31, 2020).

* cited by examiner

METROCELL ANTENNAS CONFIGURED FOR MOUNTING AROUND UTILITY POLES

CROSS-REFERENCE TO RELATED APPLICATIONS

The present application is a divisional application of U.S. patent application Ser. No. 17/275,734, filed Mar. 12, 2021, which is a 35 USC § 371 US national stage application of PCT/US2019/050562, filed Sep. 11, 2019, which claims the benefit of and priority to U.S. Provisional Patent Application Ser. No. 62/733,742, filed Sep. 20, 2018, the contents of which are incorporated herein by reference.

FIELD

The present invention relates to cellular communications systems and, more particularly, to metrocell base station antennas for cellular communications systems.

BACKGROUND

Cellular communications systems are well known in the art. In a typical cellular communications system, a geographic area is divided into a series of regions that are referred to as "cells," and each cell is served by a base station. Typically, a cell may serve users who are within a distance of, for example, 2-20 kilometers from the base station. The base station may include baseband equipment, radios and antennas that are configured to provide two-way radio frequency ("RF") communications with fixed and mobile subscribers ("users") that are positioned throughout the cell. In many cases, the cell may be divided into a plurality of "sectors" in the azimuth (horizontal) plane, and separate antennas provide coverage to each of the sectors. The antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon.

In order to increase capacity, cellular operators have been deploying so-called "metrocell" cellular base stations (which are also often referred to as "small cell" base stations). A metrocell base station refers to a low-power base station that has a much smaller range than a typical "macro cell" base station. A metrocell base station may be designed to serve users who are within, for example about five hundred meters of the metrocell antenna, although many metrocell base stations provide coverage to smaller areas such as areas having a radius of about 100-200 meters or less. Metrocell base stations are often deployed in high traffic regions within a macro cell so that the macro cell base station can offload traffic to the metrocell base station.

FIG. 1 is a schematic diagram of a conventional metrocell base station 10. As shown in FIG. 1, the metrocell base station 10 includes an antenna 20 that may be mounted on a raised structure 30 such as a utility pole. The antenna 20 may be designed to have an omnidirectional antenna pattern in the azimuth plane, meaning that at least one antenna beam generated by the antenna 20 may extend through a full 360 degree circle in the azimuth plane. Typically, the antenna 20 has a generally cylindrical shape and is mounted at the top of the utility pole.

The metrocell base station 10 also includes base station equipment such as a baseband unit 40 and a radio 42. While the radio 42 is shown as being co-located with the baseband equipment 40 at the bottom of the antenna tower 30, it will be appreciated that the radio 42 may alternatively be mounted on the utility pole 30 adjacent (e.g., directly underneath) the metrocell antenna 20. The baseband unit 40 may receive data from another source such as, for example, a backhaul network (not shown) and may process this data and provide a data stream to the radio 42. The radio 42 may generate RF signals that include the data encoded therein and may amplify and deliver these RF signals to the metrocell antenna 20 for transmission via a cabling connection 44.

SUMMARY

Pursuant to embodiments of the present invention, metrocell antennas are provided that include a first enclosure that includes a first linear array of first frequency band radiating elements mounted therein, a second enclosure that includes a second linear array of first frequency band radiating elements mounted therein, a third linear array of first frequency band radiating elements mounted within one of the first and second enclosures, a first radio frequency ("RF") port that is mounted through the first enclosure, and a first blind-mate or quick-lock connector that provides an electrical connection between the first RF port and the second linear array of first frequency band radiating elements.

In some embodiments, the antenna may be configured to wrap around a support pole.

In some embodiments, the first through third linear arrays of first frequency band radiating elements may each extend vertically, and the first enclosure may have a generally C-shaped transverse cross-section.

In some embodiments, the first enclosure may be configured to be mounted to the support pole, and the second enclosure nay be configured to be mounted to the first enclosure.

In some embodiments, the metrocell antenna may further include a plurality of reflector panels, where at least two of the reflector panels are mounted within the first enclosure and at least one of the reflector panels is mounted within the second enclosure. The first enclosure may include more reflector panels than the second enclosure in some embodiments. In an example embodiment, one of the first and second enclosures may include a total of two reflector panels and the other of first and second enclosures may include a single reflector panel. In another example embodiment, one of the first and second enclosures may include a total of five reflector panels and the other of first and second enclosures may include a total of a three reflector panels.

In some embodiments, the first and second linear arrays may be commonly connected to the first RF port and mounted on first and second of the plurality of reflector panels, respectively, and the first and sector of the plurality reflector panels may face in opposite directions when the antenna is mounted for use.

In some embodiments, the first of the plurality of reflector panels may be mounted within the first enclosure and the second of the plurality of reflector panels may be mounted within the second enclosure.

In some embodiments, the first blind-mate or quick-lock connector may be a first of a plurality of blind-mate or quick-lock connectors that provide respective electrical connections between the first enclosure and the second enclosure, and the plurality of blind-mate or quick-lock connectors may be arranged in one or more vertical columns.

In some embodiments, the first, second and third linear arrays of first frequency band radiating elements may be configured to together generate an antenna beam having a generally omnidirectional pattern in the azimuth plane.

In some embodiments, the metrocell antenna may further include first through third linear arrays of second frequency band radiating elements. In such embodiments, the first enclosure may further include the first linear array of second frequency band radiating elements mounted therein, the second enclosure may further include the second linear array of second frequency band radiating elements mounted therein and the third linear array of second frequency band radiating elements may be mounted within one of the first and second enclosures. The first, second and third linear arrays of second frequency band radiating elements may be configured to generate respective antenna beams that are configured to cover 120 degree sectors in the azimuth plane.

In some embodiments, the first RF port may comprise an RF connector that extends from the first enclosure. In other embodiments, the first RF port may comprise a connectorized pigtail that extends from the first enclosure.

Pursuant to further embodiments of the present invention, metrocell antennas are provided that include a first enclosure that includes a first RF port, a second enclosure that is configured to attach to the first enclosure to form an elongated structure that has an opening extending along a longitudinal axis thereof, and a power divider having an input port that is coupled to the first RF port mounted within the first enclosure. A first output of the power divider is coupled to a first linear array of radiating elements that is mounted within the first enclosure and a second output of the power divider is coupled to a second linear array of radiating elements that is mounted within the second enclosure via a blind-mate or quick-lock connection that extends between the first and second enclosures.

In some embodiments, the antenna may be configured to wrap around a support pole.

In some embodiments, the first enclosure may be larger than the second enclosure.

In some embodiments, the power divider may include a third output that is coupled to a third linear array of radiating elements, where the first, second and third linear arrays of radiating elements are configured to generate an antenna beam having a generally omnidirectional pattern in the azimuth plane.

In some embodiments, the first and second linear arrays of radiating elements may each extend vertically, and the first enclosure may have a generally C-shaped transverse cross-section.

In some embodiments, the first enclosure may be configured to be mounted to the support pole, and the second enclosure may be configured to be mounted to the first enclosure.

In some embodiments, the metrocell antenna may further include at least first, second and third reflector panels, where the first reflector panel is mounted in the first enclosure, the second reflector panel is mounted within the second enclosure, and the first liner array of radiating elements extends outwardly from the first reflector panel and the second linear array of radiating elements extends outwardly from the second reflector panel.

In some embodiments, the antenna may have a generally cylindrical shape.

In some embodiments, the blind-mate or quick-lock connection may comprise a capacitively-coupled blind-mate connection. In other embodiments, the first blind-mate or quick-lock connector may comprise a capacitively-coupled blind-mate connector.

DETAILED DESCRIPTION

Figure 1:
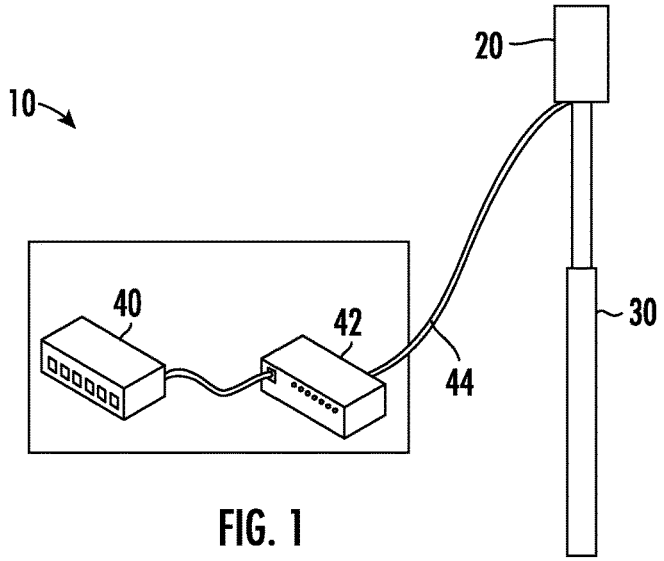
FIG. 1 PRIOR ART
FIG. 1 is a schematic view of a conventional metrocell base station.

Metrocell base station antennas are typically housed within a generally cylindrical radome and typically include three vertically-oriented linear arrays of radiating elements. The three linear arrays of radiating elements are mounted on respective reflector panels that collectively define a triangular tube within the generally cylindrical radome. Conventionally, a metrocell base station antenna is mounted on top of a utility pole such as a telephone pole, an electric power pole, a light pole or the like. With the recent deployment of fifth generation ("5G") cellular systems, metrocell antennas are now being deployed in much larger numbers and, as a result, suitable mounting locations for metrocell antennas (e.g., utility poles with a suitable mounting location for the metrocell antenna at the top of the pole that do not already have a metrocell antenna mounted thereon) are not available in many locations. If a suitable utility pole is not available, then the metrocell antennas are often mounted further down the utility poles, with the antennas offset to one side of the respective poles. However, zoning ordinances may not allow such offset mounting in some jurisdictions, and even when allowed, the resulting configuration is generally considered to be sub-optimum by wireless operators, because the metrocell antenna is much more prominent (making vandalism more likely) and less attractive, and because the utility pole scatters a portion of the antenna beam generated by the metrocell antenna, which may degrade performance.

U.S. Patent Publication No. 2016/0365624 ("the '624 publication"), which published on Dec. 15, 2016, describes wrap-around antennas that can be mounted around a utility pole (as opposed to on the top of the utility pole). The wrap-around antennas described in the '624 publication include a pair of RF ports and three linear arrays of dual-polarized radiating elements that are mounted on three respective reflector panels. The reflector panels and associated linear arrays are housed in three separate housings that are connected by hinges to provide an antenna that may be wrapped around a middle portion of a utility pole. The antennas of the '624 publication further include first and second 1×3 power dividers that split the RF signals input at the respective first and second RF ports, and cables are routed within the interior of the antenna that connect the first through third outputs of the 1×3 power dividers to the respective first through third linear arrays of radiating elements. However, the antennas disclosed in the '624 publication have a relatively complex design, and only generate two omnidirectional (in the azimuth plane) antenna beams. Moreover, extending the concept of the '624 patent to provide a metrocell antenna that generates the larger number of antenna beams desired for current metrocell antenna designs may be difficult due to the need to route many different cables between the three hinged housing pieces.

Pursuant to embodiments of the present invention, "snap-around" metrocell antennas are provided that have first and second enclosures that may be mated together around a utility pole or other support structure. In some embodiments, the first enclosure may include at least first and second linear arrays of radiating elements and the second enclosure may include at least a third linear array of radiating elements. Blind-mate, low passive intermodulation ("PIM") distortion connectors may be used to electrically connect the second enclosure to the first enclosure so that RF signals input at an RF port that is mounted on one enclosure may be passed to one or more linear arrays of radiating elements that are mounted within the other enclosure. The first enclosure may be mounted on a utility pole via, for example, mounting brackets that are captured within a pair of hose clamps that are tightened around the utility pole, and the second enclosure may be mounted to the first enclosure.

In some embodiments, the metrocell antennas may be multi-band antennas that transmits and receives RF signals in at least two different operating frequency bands. For example, the metrocell antennas may include three or more linear arrays of radiating elements that operate in a first operating frequency band that together generate an antenna beam having a generally omnidirectional pattern in the azimuth plane, and may also have three or more linear arrays of radiating elements that operate in a second operating frequency band that may generate either a generally omnidirectional antenna beam in the azimuth plane or which generate separate sector antenna beams.

The metrocell antennas according to embodiments of the present invention may be aesthetically pleasing and, because the antennas direct the antenna beams away from the support structure, scattering effects due to interference from the support structure may be eliminated.

Example embodiments of the invention will now be discussed in more detail with reference to FIGS. 2-11.

Figure 2:
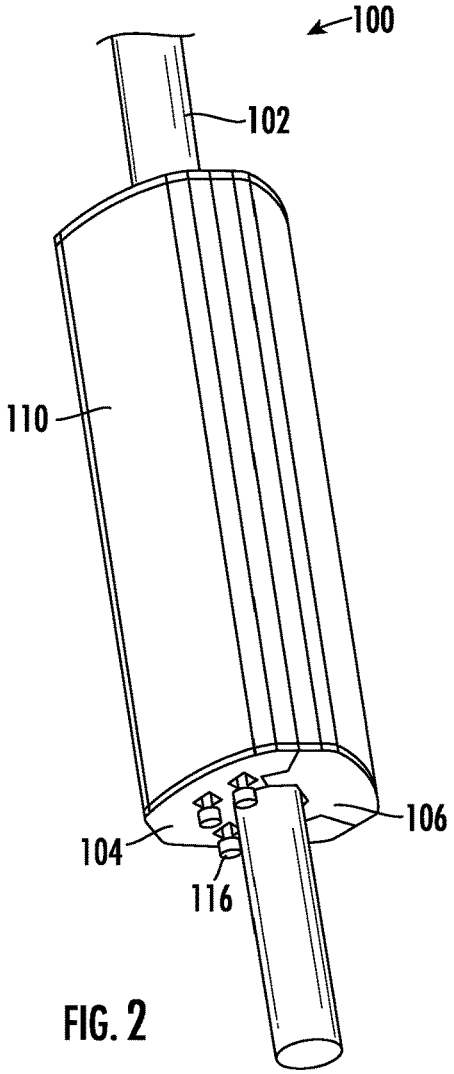
FIG. 2 is a perspective view of a snap-around metrocell antenna according to embodiments of the present invention encircling a support structure in the form of a utility pole.
Figure 3:
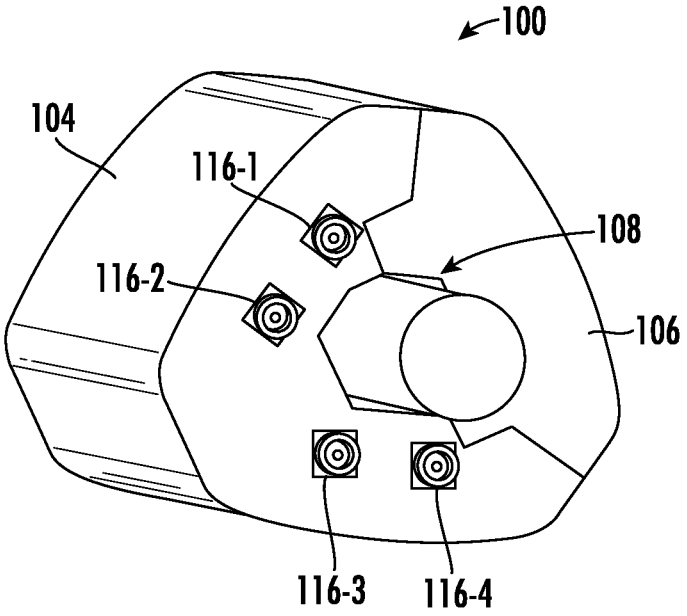
FIG. 3 is a bottom perspective view of the snap-around metrocell antenna of FIG. 2.
Figure 4:
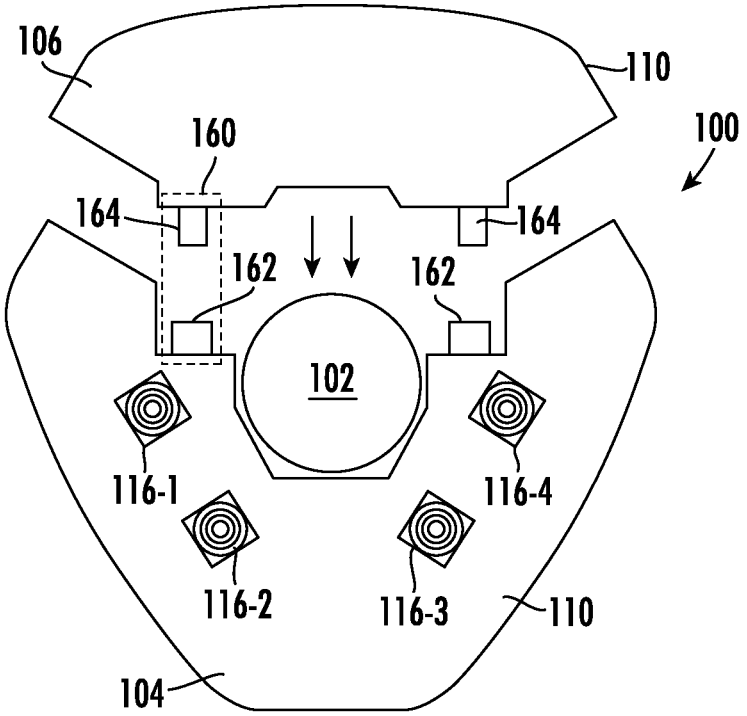
FIG. 4 is an exploded bottom view of the snap-around metrocell antenna of FIG. 2 illustrating how first and second enclosures of the antenna may be mated to mount the antenna around a utility pole or other similar support structure.
Figure 5:
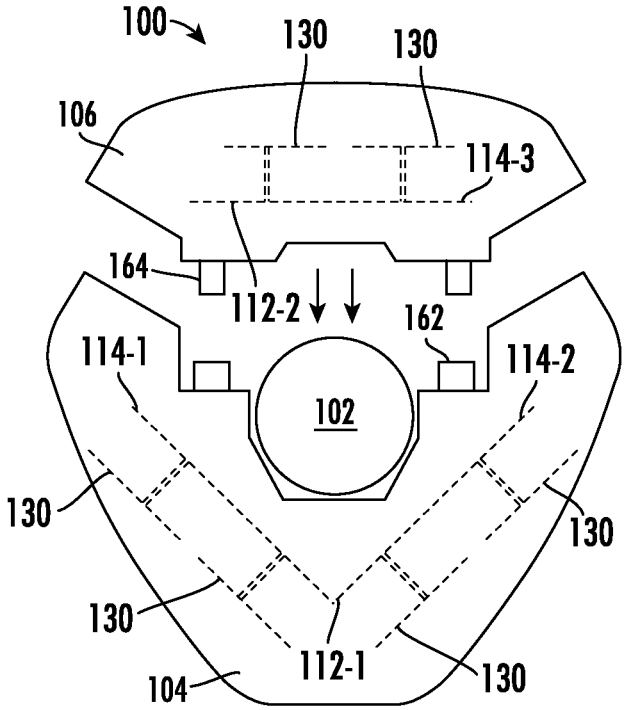
FIG. 5 is a schematic exploded top view of the snap-around metrocell antenna of FIG. 2 that shows the locations of the linear arrays of radiating elements within the antenna.
Figure 6A:
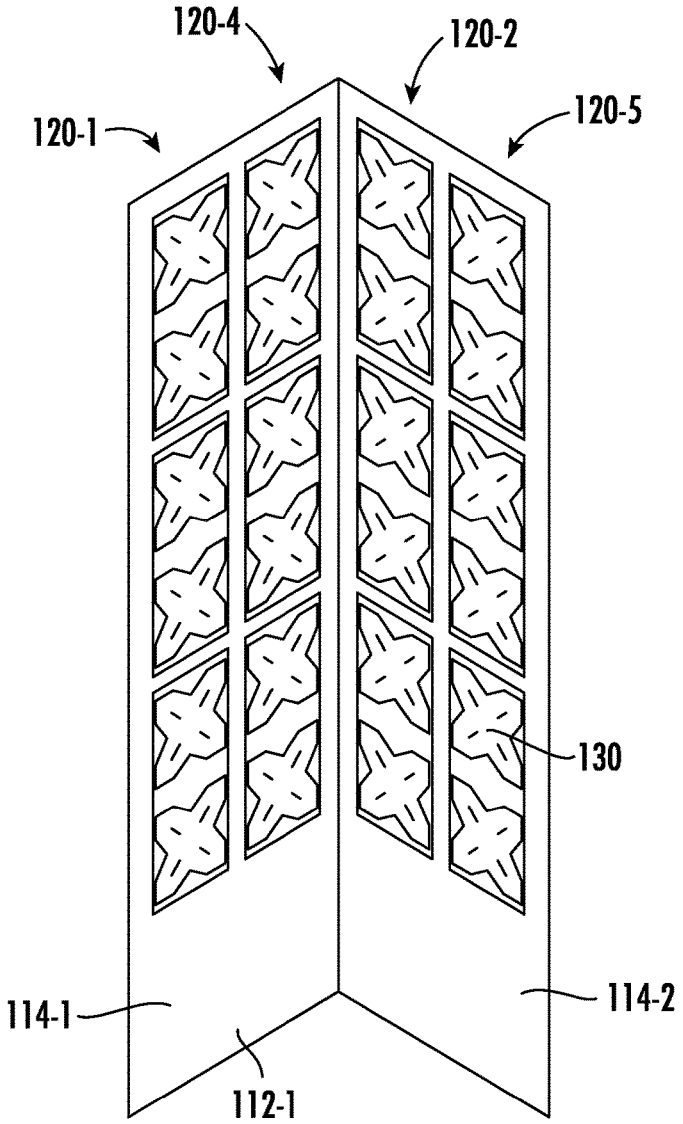
FIGS. 6A and 6B are schematic front views of the reflector panels included in the snap-around metrocell antenna of FIG. 2.
Figure 6B:
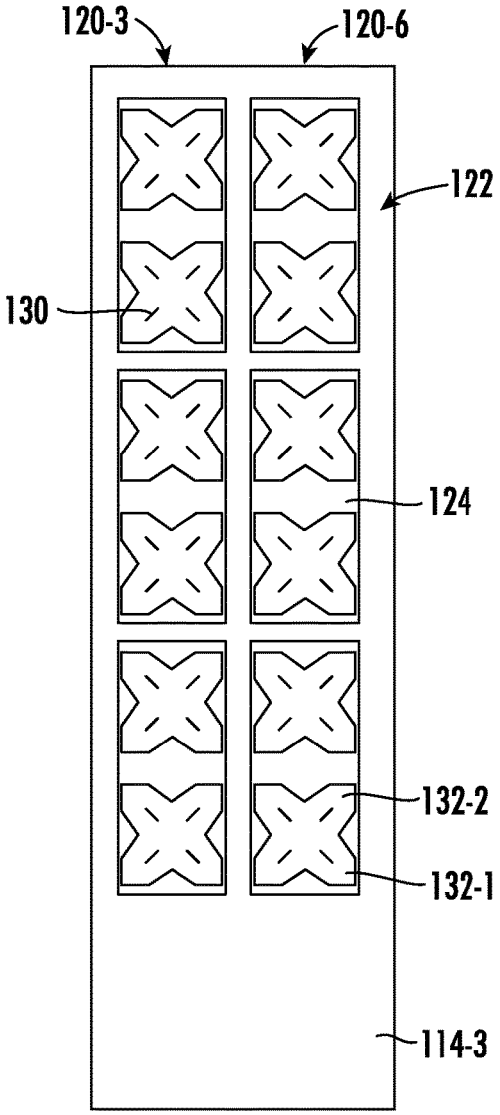
Figure 7:
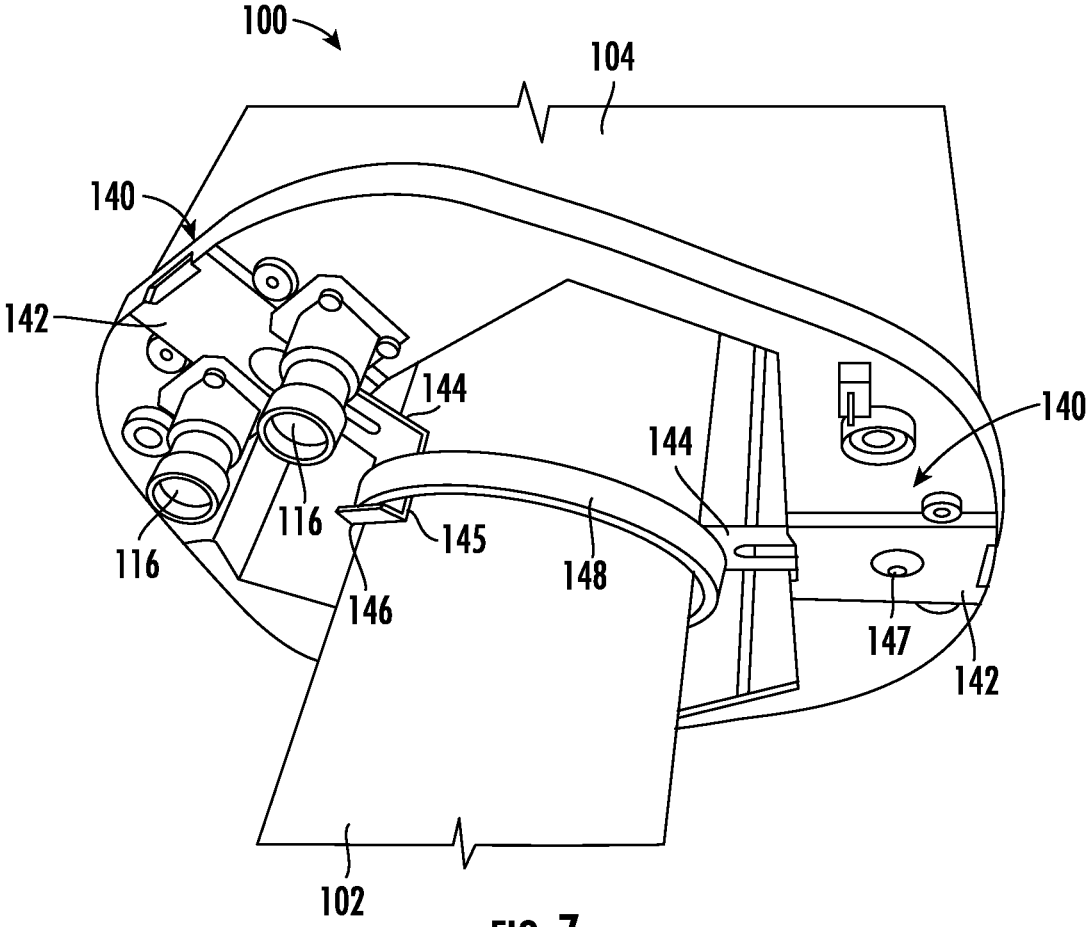
FIG. 7 is an enlarged bottom perspective view of the snap-around metrocell antenna of FIG. 2 illustrating attachment brackets and a hose clamp that may be used to mount the antenna to a utility pole.
Figure 8:
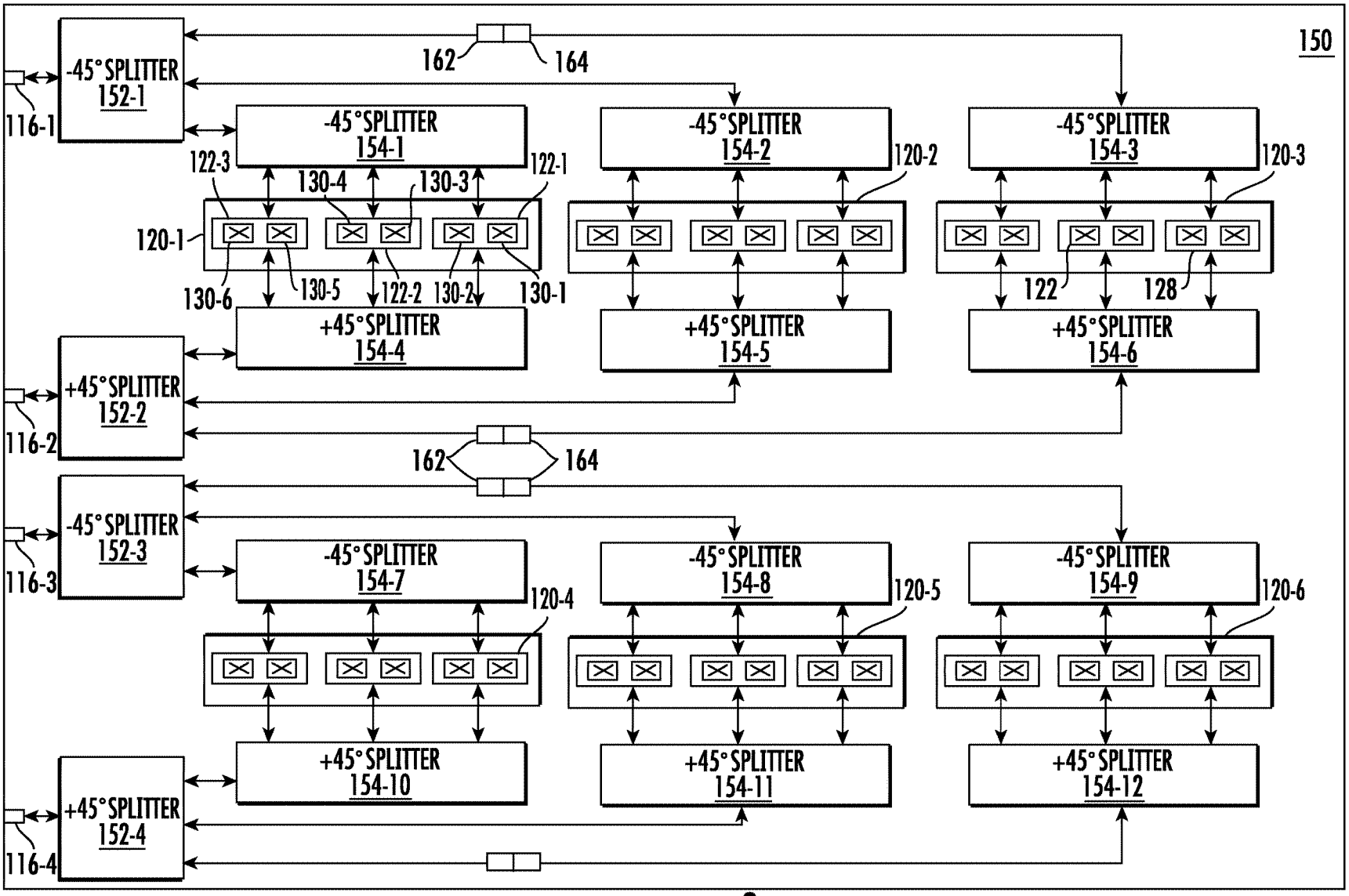
FIG. 8 is a schematic block diagram illustrating one feed network architecture for the snap-around metrocell antenna of FIG. 2.

FIGS. 2-8 illustrate the design of a "snap-around" metrocell antenna 100 according to a first embodiment of the present invention. In particular, FIG. 2 is a perspective view of a antenna 100 encircling a support structure in the form of a utility pole, and FIGS. 3 and 4 are a bottom perspective view and an exploded bottom view of the antenna 100, respectively. FIG. 5 is a schematic exploded top view of the antenna 100, and FIGS. 6A and 6B are schematic front views of the reflector panels and linear arrays of radiating elements included in the antenna 100. Finally, FIG. 7 is an enlarged bottom perspective view of the antenna 100 illustrating attachment brackets and a hose clamp that may be used to mount the antenna 100 to a utility pole 102 and FIG. 8 is a schematic block diagram illustrating one feed network architecture for the antenna 100.

Referring first to FIGS. 2-5, the snap-around metrocell antenna 100 according to embodiments of the present invention is shown encircling a central section of a support structure in the form of a utility pole 102. The metrocell antenna 100 has a generally cylindrical shape, and includes a central opening 108. The longitudinal axis of the cylinder defined by the metrocell antenna 100 and the central opening 108 will both extend in the vertical direction (i.e., perpendicular to a plane defined by the horizon) when the metrocell antenna 100 is mounted on the utility pole 102 for normal use.

As shown in FIGS. 2-6B, the snap-around metrocell antenna 100 includes first and second enclosures 104, 106 that can be attached together to capture the utility pole 102 therebetween so that the utility pole 102 extends through the central opening 108. Each enclosure 104, 106 may include a radome 110 and a frame 112 (see FIGS. 4-5 and 6A-6B) The radome 110 may be substantially transparent to RF radiation in the operating frequency band(s) of the metrocell antenna 100 and may seal and protect internal components the metrocell antenna 100 from adverse environmental conditions. Each frame 112 may include one or more reflector panels 114, and may also include one or more support brackets (not shown) that provide added structural rigidity to the reflector panels 114.

As shown best in FIGS. 3-5, the first enclosure 104 may have a generally C-shaped transverse cross-section when the metrocell antenna 100 is mounted for use. The second enclosure 106 may have a generally arcuate-shaped transverse cross section (e.g., a portion of a circle that is somewhat less than a semicircle). The second enclosure 106 may be configured to be attached to the first enclosure 104 so that the utility pole (or other support structure) 102 extends through the opening 108 and is captured between the first and second enclosures 104, 106.

A plurality of RF ports 116 may be mounted in, for example the bottom surfaces of one or both of the first and second enclosures 104, 106. In the depicted embodiment, a total of four RF ports 116-1 through 116-4 are included in antenna 100, all of which are mounted through the bottom surface of the first enclosure 104. It will be appreciated, however, that some or all of the RF ports 116 could alternatively be mounted in the bottom surface of the second enclosure 106. It will also be appreciated that the number of RF ports 116 will vary based on the number of linear arrays of radiating elements included in the antenna 100 and the configuration thereof. It should be noted that herein, when multiple like or similar elements are provided, they may be labelled in the drawings using a two-part reference numeral (e.g., RF port 116-2). Such elements may be referred to herein individually by their full reference numeral (e.g., RF port 116-2) and may be referred to collectively by the first part of their reference numeral (e.g., the RF ports 116).

At least one frame 112 is included in each enclosure 104, 106. The first frame 112-1 that is mounted within the first enclosure 104 comprises first and second reflector panels 114-1, 114-2. The second frame 112-2 that is mounted within the second enclosure 106 comprises a third reflector panel 114-3. Each reflector panel 114 may comprise a generally planar metal sheet that extends vertically within the antenna 100. While not shown in the figures, one or more edges of the reflector panels 114 may include lips or other features that provide enhanced structural rigidity. In some embodiments, the first and second reflector panels 114-1, 114-2 that are mounted within the first enclosure 104 may be formed of a unitary piece of metal that is bent to have a generally V-shaped transverse cross section, as can best be seen in FIGS. 5 and 6A.

One or more linear arrays 120 of radiating elements 130 may be mounted to extend outwardly from each reflector panel 114. In the depicted embodiment, two linear arrays 120 are mounted on each reflector panel 114 so that the metrocell antenna 100 includes a total of six linear arrays 120-1 through 120-6 of radiating elements 130. In the depicted embodiment, each linear array 120 includes a plurality of so-called "mid-band" radiating elements 130 that are configured to operate in, for example, the 1.7-2.7 GHz operating frequency band or portions thereof. However, as is discussed in greater detail below, it will be appreciated that metrocell antenna 100 represents just one of many, many different configurations of linear arrays of radiating elements that may be included in the snap-around metrocell antennas according to embodiments of the present invention, and hence the metrocell antenna will be understood to simply represent one example embodiment.

As shown best in FIGS. 5 and 6A-6B, each linear array 120 of radiating elements 130 includes a total of six dual-polarized radiating elements 130. In the depicted embodiment, each radiating element 130 is implemented as a dual polarized slant −45°/+45° cross dipole radiating element that includes a first dipole radiator 132-1 that is mounted at an angle of −45° with respect to the plane defined by the horizon and a second dipole radiator 132-2 that is mounted at an angle of +45° with respect to the plane defined by the horizon. As is well understood by those of skill in the art, a first RF signal may be fed to the first dipole radiators 132-1 of one or more of the linear arrays 120 in order to generate a first antenna beam that has a −45° polarization, and a second RF signal may be fed to the second dipole radiators 132-2 of one or more of the linear arrays 120 in order to generate a second antenna beam that has a +45° polarization. The first and second antenna beams may generally be orthogonal to each other (i.e., non-interfering) due to the orthogonal polarizations of the antenna beams.

As can also be seen in FIGS. 6A-6B, the radiating elements 130 in each linear array 120 may be arranged in sub-arrays 122. Each sub-array 122 of radiating elements may include one or more radiating elements 130, with one to four radiating elements per sub-array 122 being the most common. In the depicted embodiment, each sub-array 122 includes two radiating elements 130. Each sub-array 122 may comprise a feed board assembly that includes a feed board printed circuit board 124 that has two radiating elements 130 mounted thereon. Each feed board printed circuit board 124 may receive sub-component of the RF signals that are to be transmitted at the two different polarizations, sub-divide those sub-components of the RF signals, and provide the sub-divided sub-components to the appropriate dipole radiators 132 of the radiating elements 130 that are mounted on the feed board printed circuit board 124.

The first through third linear arrays 120-1 through 120-3 may all be commonly connected to the first and second RF ports 116-1, 116-2. In such a configuration, the linear arrays 120 may be used to generate a pair of antenna beams (one for each polarization) that have generally omnidirectional coverage in the azimuth plane. In the depicted embodiment, the fourth through sixth linear arrays 120-4 through 120-6 are similarly commonly connected to the third and fourth RF ports 116-3, 116-4, and may be used to generate a second pair of antenna beams that have generally omnidirectional coverage in the azimuth plane. It will be appreciated, however, that some of the linear arrays may alternatively be configured as sector antennas in other embodiments. For example, in another embodiment, a total of eight RF ports 116 could be provided. In such an embodiment, a first pair of the RF ports 116 may be coupled to the first through third linear arrays 120-1 through 120-3 to form a pair of omnidirectional antenna beams in the azimuth plane, and the remaining three pairs of RF ports 116 may be coupled to the respective fourth through sixth linear arrays 120-4 through 120-6 so that each of the linear arrays 120-4 through 120-6 generate a pair of sector antenna beams (one for each polarization) that have, for example, a half power beamwidth of about 120 degrees in the azimuth plane.

While cross-dipole radiating elements 130 are included in the antenna 100 of FIGS. 2-8, it will be appreciated that any suitable type of radiating element may be used, including single dipole radiating elements, patch radiating elements and the like. It should also be noted that each linear array 120 may include any number of radiating elements 130 in keeping with the disclosure, where the number of radiating elements 130 that are included is typically based on a desired elevation beamwidth for the antenna beams generated by the linear arrays 120. It will also be appreciated that the antennas according to embodiments of the present invention may include different numbers of reflector panels (e.g., four or more), different numbers of linear arrays per reflector panel, and that different ones of the linear arrays may include radiating elements that are configured to transmit and receive signals in different frequency bands.

In an example embodiment, brackets 140 and hose clamps 148 may be used to attach the antenna 100 to a utility pole 102. While the brackets 140 and hose clamps 148 are omitted from most of the figures to simplify the drawings, FIG. 7 illustrates a pair a brackets 140 and a hose clamp 148 that may be used to mount the antenna 100 to a utility pole 102. While FIG. 7 illustrates brackets 140 and a hose clamp 148 that are at the bottom of the antenna 100, it will be appreciated that a similar set of brackets 140 and a second hose clamp 148 may also be provided at the top of the antenna 100 in order to securely mount the antenna 100 to the utility pole 102.

As shown in FIG. 7, the brackets 140 may be secured to the bottom surface of the first enclosure 104 in some embodiments. Each mounting bracket 140 may comprise an adjustable bracket that has a variable length. In the depicted embodiment, each bracket 140 includes a first member 142 that is affixed to the enclosure 104 and a second member 144 that is slidably received within the first member 142. A bolt 147 and nut (not shown) may be used to fix the position of the second member 144 relative to the first member 142 of each bracket 140. A distal end of each second member 144 includes a downwardly extending flange 145 and an inwardly extending lip 146. A hose clamp 148 may be loosely positioned around the utility pole 102, and the downwardly extending flanges 145 of the second members 144 of each bracket 140 may be inserted between the hose clamp 148 and the utility pole 102. The hose clamp 148 may then be tightened around the utility pole 102 in order to firmly capture the downwardly extending flanges 145 of the second members 144 of the brackets 140 between the hose clamp 148 and the utility pole 102. As noted above, a similar arrangement of brackets 140 may be included at the top of the antenna 100 that are captured between a second hose clamp 148 and the utility pole 102. In this fashion, the antenna 100 may be firmly mounted to the utility pole 102 without the need for providing any mounting brackets, apertures or other mounting features on the utility pole 102.

Utility poles may have various diameters. Since the brackets 140 have an adjustable length, the antenna 100 may be mounted on utility poles 102 having a range of different diameters.

As noted above, the antenna 100 is configured to generate four antenna beams that each have a generally omnidirectional pattern in the azimuth plane. As is known to those of skill in the art, an antenna beam having a generally omnidirectional pattern in the azimuth plane may be generated by splitting an RF signal into three, equal magnitude sub-components that are passed to three respective linear arrays of radiating elements that are mounted at 120° intervals in the azimuth plane.

FIG. 8 is a block diagram illustrating one possible feed network 150 that could be included in the antenna 100. The feed network 150 may include a plurality of coaxial cables (shown as unnumbered connection lines in FIG. 8) or other RF transmission paths as well as a plurality of power splitter/combiners that subdivide RF signals along the transmit path for transmission through various of the radiating elements 130 and that combine sub-components of an RF signal received at the various radiating elements 130 in the receive path.

As shown in FIG. 8, an RF port 116-1 is provided that may be coupled to a first port of a radio. The radio may pass RF signals through RF port 116-1 to the antenna 100. Each such RF signal is passed from RF port 116-1 to a 1×3 power splitter/combiner 152-1 that splits the RF signal into three equal magnitude sub-components. The first sub-component of the RF signal is passed from 1×3 power splitter/combiner 152-1 to a first 1×3 power splitter/combiner 154-1 that divides the first sub-component of the RF signal into three portions which may or may not have equal magnitudes. The first portion of the first sub-component of the RF signal is passed to a first sub-array 122-1 of linear array 120-1 that includes first and second radiating elements 130-1, 130-2 where it is yet again sub-divided and the two sub-portions are then transmitted through the −45° dipole radiators 132 of the respective first and second radiating elements 130-1, 130-2 of the first linear array 120-1. The second portion of the first sub-component of the RF signal is passed to a second sub-array 122-2 that includes third and fourth radiating elements 130-3, 130-4, and the second portion is further sub-divided and the two sub-portions are then transmitted through the −45° dipole radiators 132 of the respective third and fourth radiating elements 130-3, 130-4. The third portion of the first sub-component of the RF signal is passed to a third sub-array 122-3 that includes fifth and sixth radiating elements 130-5, 130-6, and the third portion is further sub-divided and the two sub-portions are then transmitted through the −45° dipole radiators 132 of the respective fifth and sixth radiating elements 130-5, 130-6.

Similarly, the second sub-component of the RF signal is passed to a second 1×3 power splitter/combiner 154-2 and the third sub-component of the RF signal is passed to a third 1×3 power splitter/combiner 154-3 that divide the respective second and third sub-components of the RF signal into three portions which again may or may not have equal magnitudes. The second and third sub-components of the RF signal are then passed to the first through sixth radiating elements 130 of the respective second and third linear arrays 120-2, 120-3 in the exact same fashion, described above, that the first sub-component of the RF signal is passed to the first through sixth radiating elements 130 of the first linear array 120-1. In this fashion, an RF signal that is input at RF port 116-1 may be split into first through third sub-components that are transmitted through the respective first through third linear arrays 120-1 through 120-3 to generate an antenna beam that has a generally omnidirectional azimuth pattern and a −45° polarization.

A second RF signal may be input to antenna 100 at RF port 116-2 that is fed to the +45° dipole radiators 132 of the radiating elements 130-1 through 130-6 of each of linear arrays 120-1 through 120-3 to generate, in the exact same fashion, a second antenna beam that has a generally omnidirectional azimuth pattern and a +45° polarization. In the embodiment of FIGS. 2-8, the fourth through sixth linear arrays 120-4 through 120-6 may be identical to the first through third linear arrays 120-1 through 120-3, except that linear arrays 120-4 through 120-6 are coupled to RF ports 116-3 and 116-4 instead of to RF ports 116-1 and 116-2. Thus, as linear arrays 120-4 through 120-6 may operate in the exact same fashion as linear arrays 120-1 through 120-3 to generate third and fourth antenna beams that have generally omnidirectional azimuth patterns, further description thereof will be omitted.

As noted above, the antenna 100 may comprise a "snap-on" antenna. By "snap-on" it is meant that the second enclosure 106 may attach to the first enclosure 104 to form the complete antenna 100 using, for example, screws, bolts, clips or other fasteners. In some embodiments, the second enclosure 106 may only attach to the first enclosure 104 and may not be directly attached to the utility pole 102. In other embodiments, the second enclosure 106 may directly attach to the first enclosure 104 and may also be directly attached to the utility pole 102.

As described above with reference to FIGS. 5, 6A-6B and 8, each RF port 116 of antenna 100 may be coupled to three of the linear arrays 120, where two of the linear arrays (e.g., linear arrays 120-1, 120-2) are within the first enclosure 104 and the third linear array (e.g., linear array 120-3) is within the second enclosure 106. Consequently, it is necessary to provide electrical connections 160 between the first and second enclosures 104, 106 that allow RF signals that are input to, for example, the first enclosure 104 to be coupled to linear arrays 120 that are within the second enclosure 106. This may be accomplished, for example, using matching blind-mate connectors 162, 164. Blind-mate connectors are known in the art, with examples of the blind-mate connectors being disclosed in, for example, U.S. Patent Publication No. 2016/0104969, published Apr. 14, 2016, U.S. Pat. No. 9,219,461, each of which are incorporated herein by reference. The blind-mate connectors 162, 164 may comprise, for example, connectors having capacitive connections that exhibit very low levels of PIM distortion. Generally-speaking, a blind-mate connection refers to an electrical connection between two connectors that slip together with no fastening mechanism built into the connectors. The two connectors may be individual connectors that provide a single electrical connection of cluster connectors that provide a plurality of electrical connections, or a combination thereof (e.g., a cluster connector on one side of the blind-mate connection, and a plurality of individual connectors on the other side of the blind-mate connection that mate with the single cluster connector). The connectors used to form a blind-mate connection are referred to as blind-mate connectors.

While the use of blind-mate connections 160 formed using blind-mate connectors 162, 164 may be advantageous in many applications, it will be appreciated that connectors that require a small amount of movement to lock in place such as, for example, latch-fastened connectors or quarter-turn or half-turn connectors may alternatively be used in some embodiments to form the electrical connections between the first and second enclosures 104, 106. Herein, such latch-fastened connectors or quarter-turn or half-turn connectors are referred to as "quick-lock" connectors. It will be appreciated, therefore, that the blind-mate connectors 162, 164 that are schematically pictured in the figures may be replaced with quick-lock connectors pursuant to further embodiments of the present invention. When quick-lock connectors are used, the connectors may be located closer to the edges of the first and second enclosures 104, 106 in order to allow an installer to access and activate the fastening mechanisms for the quick-lock connectors during installation. Alternatively, the fastening mechanisms (or a locking mechanism that activates the fastening mechanisms for multiple quick-lock connections) may extend outside the first and second enclosures 104, 106.

FIGS. 4 and 5 illustrate the locations of the blind-mate connectors 162, 164 that form the blind-mate connections 160 in the antenna 100. As shown, a matching pair of blind-mate connectors 162, 164 may be provided for each electrical connection 160 between the first enclosure 104 and the second enclosure 106. The blind-mate connectors 162, 164 may be mounted on the sidewalls of enclosures 104, 106 that will comprise interior sidewalls once the enclosures 104, 106 are mated together. In the depicted embodiment, the blind-mate connectors 162 are arranged in two vertical columns that each have two blind-mate connectors 162, and the blind-mate connectors 164 are likewise arranged in two vertical columns that each have two blind-mate connectors 164. This arrangement may provide room for up to twenty blind-mate connections 160 that are arranged in two vertically-extending columns assuming standard sized blind-mate RF connectors 162, 164 and a metrocell antenna having a height of about two feet. The locations of the blind-mate connectors 162, 164 along the electrical paths are illustrated in FIG. 8 for reference. While not shown in the drawings, alignment features such as matching tapered pins and sockets may be included in the first and second enclosures 104, 106 that ensure that the blind-mate connectors 162-164 properly mate when the second enclosure 106 is mated with the first enclosure 104.

Figure 9:
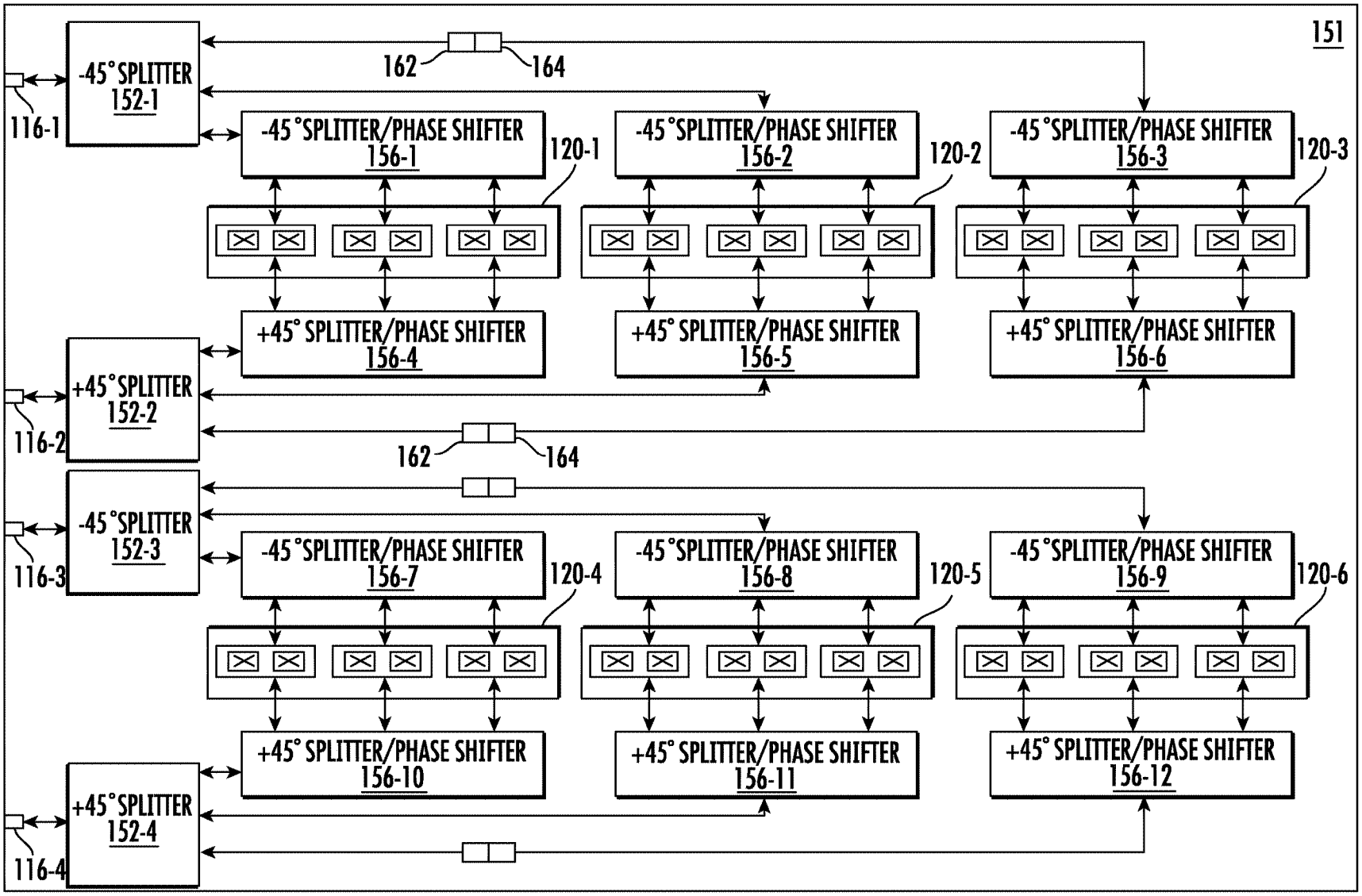
FIG. 9 is a schematic block diagram illustrating another feed network architecture for the snap-around metrocell antenna of FIG. 2.

FIG. 9 is a schematic block diagram illustrating another possible feed network 151 for the snap-around antenna 100 of FIGS. 2-7. As shown in FIG. 9, the feed network 151 is similar to the feed network 150 of FIG. 8, except that the 1×3 power splitter combiners 154 are replaced with 1×3 power splitter combiners 156 that each include an integrated phase shifter as well as the power splitter combiner. The phase shifter portion of the power splitter combiners-phase shifters 156 may be configured to apply a phase taper to the sub-components of an RF signal that are fed to the radiating elements 130 of each of the linear arrays 120 in order to implement a downtilt in the elevation pattern of the omnidirectional antenna beam. Each 1×3 power splitter combiner-phase shifter 156 may be implemented using, for example, variable wiper-arc phase shifters such as the phase shifters disclosed in U.S. Pat. No. 7,907,096, which is incorporated herein by reference. It will be appreciated, however, that any appropriate variable phase shifter may be used such as, for example, sliding dielectric phase shifters. It will also be appreciated that a fixed phase shift may be used instead of a variable phase shift in some embodiments. Such a fixed phase shift may be achieved, for example, by using different length coaxial cables between the 1×3 power splitter combiner 154 and each sub-array 122 in the feed network 150 of FIG. 8. It will also be appreciated that the antenna 100 may include one or more remote electrical tilt ("RET") actuators (not shown) that may be used to adjust the phase shifters, and hence the degree of downtilt of the antenna beams in the elevation plane, in response to control signals sent from a remote location, or may be configured so that a technician may manually adjust the downtilt.

As noted above, the antenna 100 is configured to generate a total of four antenna beams, each of which has a generally omnidirectional antenna pattern in the azimuth plane. As also discussed above, in other embodiments, the antenna 100 may be modified so that three of the linear arrays (e.g., linear arrays 120-4 through 120-6) are operated as sector antennas. In such embodiments, the 1×3 power splitter/combiners 152-3 and 152-4 may be omitted from the feed networks 150, 151 discussed above, and four additional RF ports 116-5 through 116-8 may be added to the antenna 100. RF ports 116-3 through 116-8 may then be directly connected to the respective 1×3 RF splitter/combiners 154-7 through 154-12 to reconfigure linear arrays 120-4 through 120-6 to operate as sector antennas.

In some embodiments, the radiating elements 130 may be configured to operate in multiple cellular frequency bands. In such embodiments, diplexers (not shown) may be included within the antenna 100 (at a suitable location within the feed network) that allow the antenna 100 to operate in additional frequency bands. In such designs, the antenna 100 will include additional RF ports 116 to couple RF signals in the additional frequency bands to and from the linear arrays 120 of antenna 100.

While FIGS. 2-9 illustrate example implementations of a snap-around metrocell antenna 100 that includes three reflector panels 114 and a total of six linear arrays 120, it will be appreciated that embodiments of the present invention are not limited thereto. For example, in other embodiments, the antenna may have four, six, eight, ten or twelve reflector panels. Moreover, the number of linear arrays included on each reflector panel may also be varied, with reflector panels including anywhere from, for example, one to six linear arrays of radiating elements. Moreover, unlike the antennas discussed above with reference to FIGS. 2-9, different linear arrays may include different types of radiating elements that are designed to operate in more widely spaced apart operating frequency bands. A few additional examples of metrocell antennas according to embodiments of the present invention are discussed below with reference to FIGS. 10A-11 that include larger numbers of linear arrays and different numbers of reflector panels.

Figure 10A:
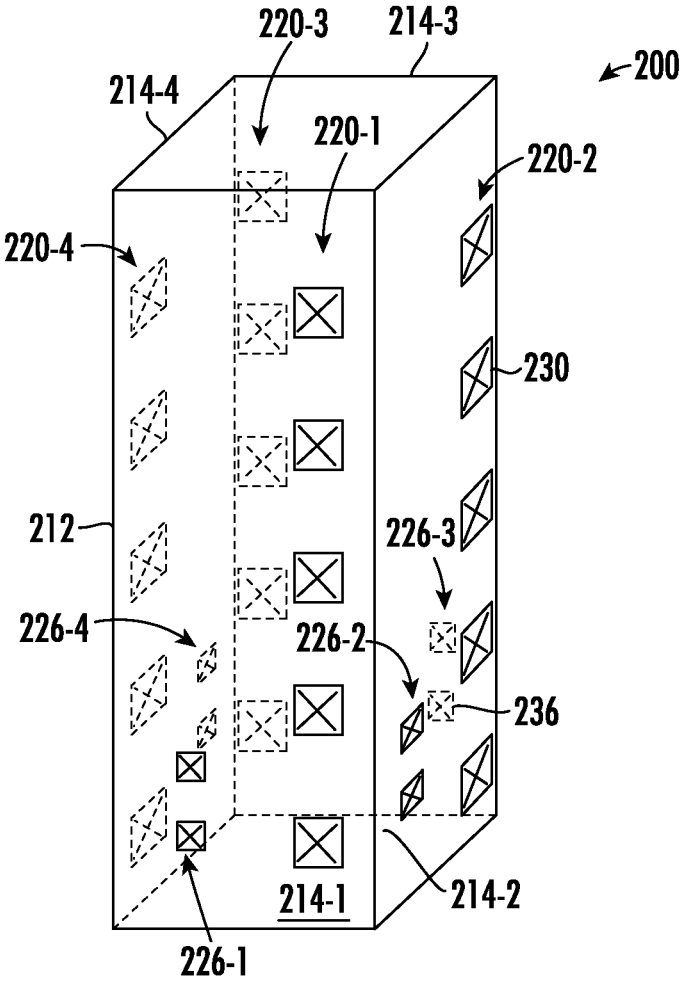
FIG. 10A is a schematic perspective view of the reflector panels and linear arrays of radiating elements of a metrocell antenna according to further embodiments of the present invention.
Figure 10B:
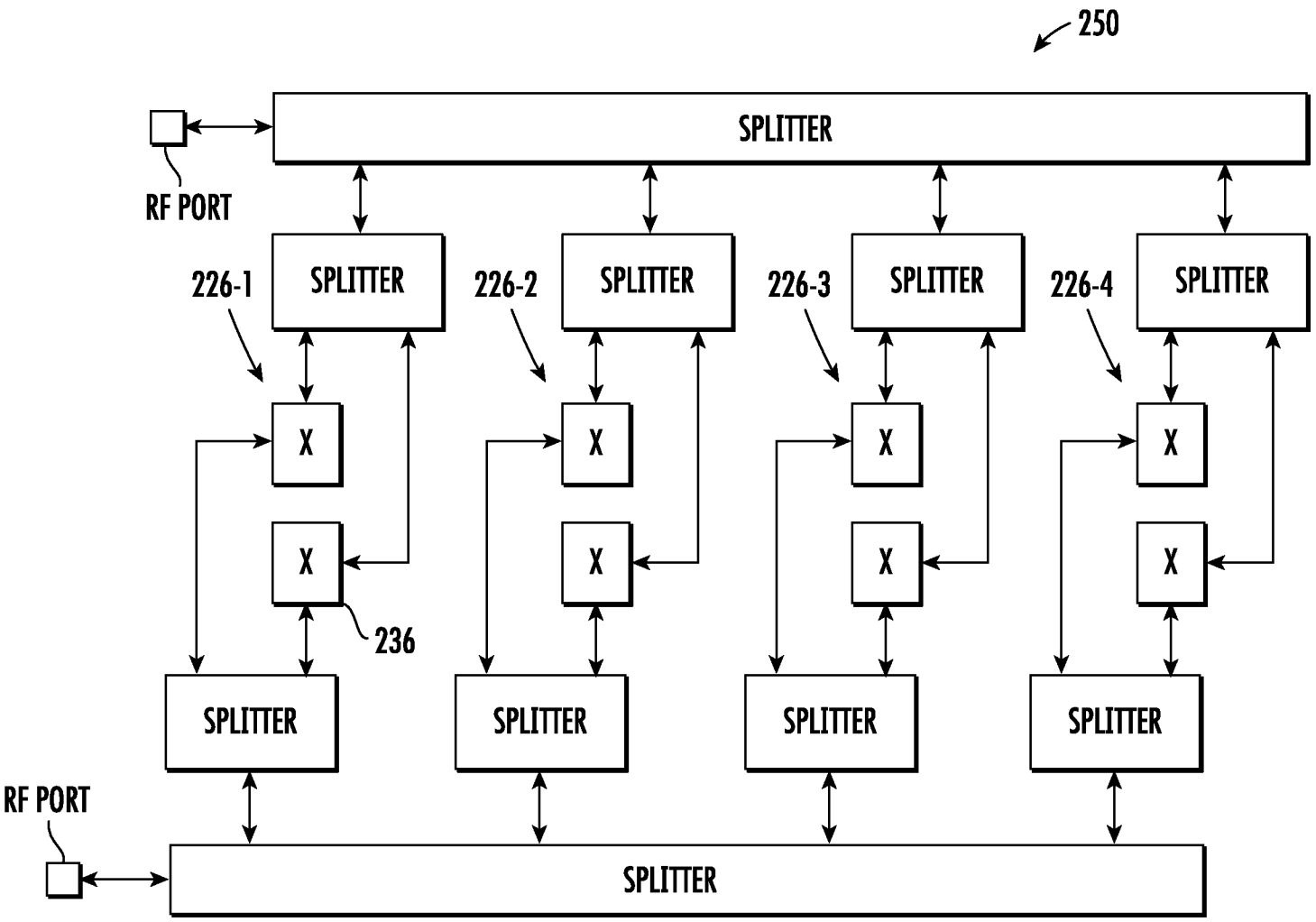
FIG. 10B is a schematic block diagram illustrating a feed network architecture for the linear arrays of high-band radiating elements included in the metrocell antenna of FIG. 10A.
Figure 10C:
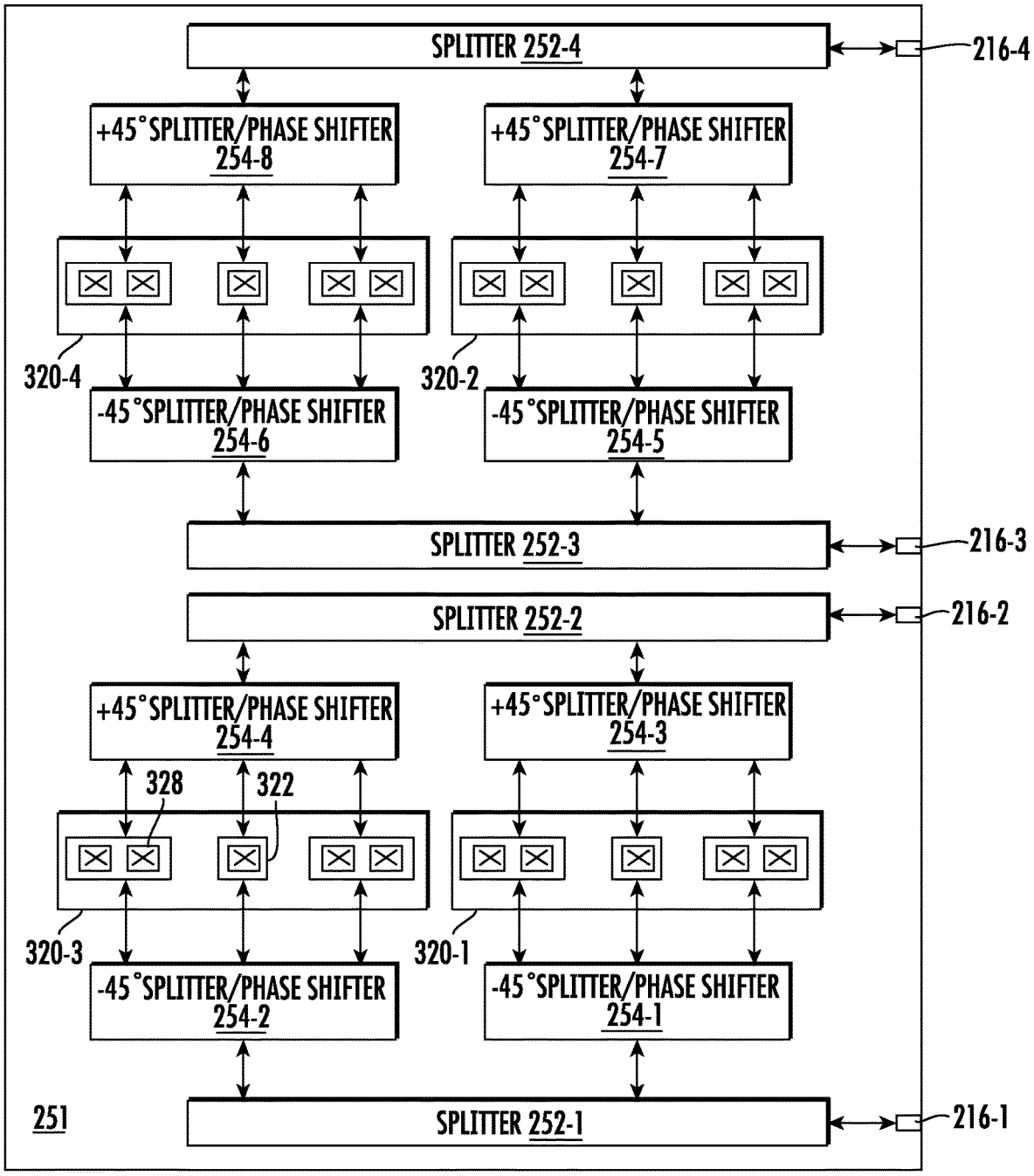
FIG. 10C is a schematic block diagram illustrating a feed network architecture for the linear arrays of mid-band radiating elements included in the metrocell antenna of FIG. 10A.

Referring first to FIGS. 10A-10D, FIG. 10A provides a schematic perspective view of the reflector panels and linear arrays of radiating elements of a snap-around metrocell antenna 200 according to further embodiments of the present invention, while FIGS. 10B and 10C are schematic diagrams illustrating the feed network architectures for the respective mid-band and high-band linear arrays of radiating elements included in the antenna 200 of FIG. 10A. The antenna 200 is an example of an "orthogonal peanut" metrocell antenna that uses four linear arrays of radiating elements to generate antenna beams having a generally omnidirectional pattern in the azimuth plane. A wide variety of different orthogonal peanut antennas are disclosed in U.S. patent application Ser. No. 16/034,617, filed Jul. 13, 2018, and U.S. patent application Ser. No. 15/876,546, filed Jan. 22, 2018, the entire content of each of which is incorporated herein by reference. Any of the antennas disclosed in the patent applications referenced immediately above may be designed as snap-around antennas according to embodiments of the present invention by incorporating some of the reflector panels and linear arrays thereof in a first enclosure and the remainder of the reflector panels and linear arrays thereof in a second enclosure that is configured to attach to the first enclosure and capture a utility pole 102 therebetween, and by including blind-mate connections that provide the necessary electrical connections between the first and second enclosures.

As shown in FIG. 10A, the metrocell antenna 200 includes a rectangular tubular frame 212 that has four reflector panels 214-1 through 214-4. In the depicted embodiment, each reflector panel 214-1 through 214-4 has a respective one of four vertically-oriented linear arrays 220-1 through 220-4 of mid-band radiating elements 230 mounted to extend outwardly therefrom. In the depicted embodiment, each linear array 220 includes a total of five mid-band radiating elements 230. Each of the radiating elements 230 may be identical and may be identical to the slant −45°/+45° cross-dipole mid-band radiating elements 130 described above, and hence further description thereof will be omitted. Each reflector panel 214-1 through 214-4 also has a respective one of four vertically-oriented linear arrays 226-1 through 226-4 of high-band radiating elements 236 mounted to extend outwardly therefrom. In the depicted embodiment, each linear array 226 includes a total of two high-band radiating elements 236. The high-band radiating elements 236 may comprise, for example, cross-dipole radiating elements that are configured to operate in all or part of the 3.3-4.2 GHz frequency band or cross-dipole radiating elements that are configured to operate in all or part of the 5.1-5.4 GHz frequency band.

As shown in FIG. 10B, the four linear arrays 226 of high-band radiating elements 236 are commonly fed from two RF ports. Thus, the antenna 200 will generate first and second high-band antenna beams that each has a generally omnidirectional pattern in the azimuth plane.

FIG. 10C illustrates a feed network 251 that may be used to pass RF signals between a mid-band radio and the mid-band radiating elements 230 of metrocell antenna 200. As shown in FIG. 10C, the antenna 200 has four mid-band ports 216-1 through 216-4 that may be connected to four ports of a mid-band radio (not shown) via, for example, coaxial jumper cables.

As shown in FIG. 10C the first RF port 216-1 is coupled to the −45° radiators 232-1 of the mid-band radiating elements 230 of linear arrays 220-1 and 220-3 via a first 1×2 power splitter/combiner 252-1. An RF transmission line (e.g., a coaxial cable) may extend between the first RF port 216-1 and the splitter/combiner 252-1. The 1×2 splitter/combiner 252-1 may split RF signals received from RF port 216-1 into two equal magnitude sub-components that are fed to respective power splitter/combiners-phase shifters 254-1, 254-2 that are associated with the respective linear arrays 220-1, 220-3. Similarly, the second RF port 216-2 is coupled to the +45° radiators 232-2 of the radiating elements 230 of linear arrays 220-1, 220-3 via a second 1×2 power splitter/combiner 252-2. The splitter/combiner 252-2 may split RF signals received from RF port 216-2 into equal magnitude sub-components that are fed to respective power splitter/combiners-phase shifters 254-3, 254-4 that are also associated with the respective linear arrays 220-1, 220-3.

Similarly, the third RF port 216-3 is coupled to the −45° radiators 232-1 of the radiating elements 230 of linear arrays 220-2, 220-4 via a third power splitter/combiner 252-3 which splits RF signals received from RF port 216-3 into equal magnitude sub-components that are fed to respective power splitter/combiners-phase shifters 254-5, 254-6 that are associated with linear arrays 220-2, 220-4, respectively. The fourth RF port 216-4 is coupled to the +45° radiators 232-2 of the radiating elements 230 of linear arrays 220-2, 220-4 via a fourth splitter/combiner 252-4 which splits RF signals received from port 216-4 into equal magnitude sub-components that are fed to respective power splitter/combiners-phase shifters 254-7, 254-8 that are associated with linear arrays 220-2, 220-4, respectively.

As shown in FIG. 10C, each power splitter/combiners-phase shifter 254 may split the RF signals input thereto three ways (and the power split may be equal or unequal) and may apply a phase taper across the three sub-components of the RF signal to, for example, apply an electronic downtilt to the antenna beam that is formed when the sub-components of the RF signal are transmitted (or received) through the respective linear arrays 220.

When an RF signal is applied to RF port 216-1, the first and third linear arrays 220-1, 220-3 together form a first antenna beam having a −45° polarization that has a peanut-shaped cross-section in the azimuth plane. Likewise, when an RF signal is applied to RF port 216-3, the second and fourth linear arrays 220-2, 220-4 may together form a second antenna beam having a −45° polarization that has a peanut-shaped cross-section in the azimuth plane. Together, these two antenna beams may provide omnidirectional coverage in the azimuth plane. A second identical pair of antenna beams that each have a +45° polarization are generated when RF signals are applied to RF ports 216-2 and 216-4.

Figure 10D:
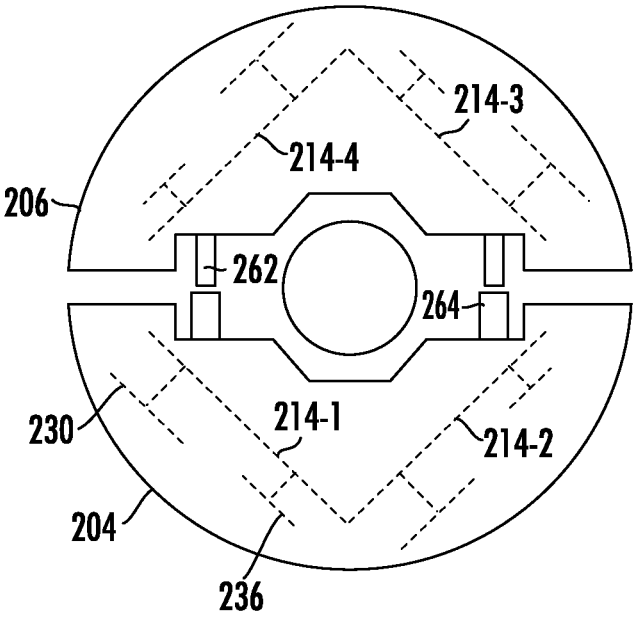
FIG. 10D is a schematic diagram illustrating how the antenna of FIG. 10A may be implemented as a snap-on antenna.

The metrocell antenna 200 may be implemented as a snap-on antenna according to embodiments of the present invention. For example, referring to FIG. 10D, in an example embodiment, reflector panels 214-1 and 214-2 could be mounted within a first enclosure 204 that is similar to the first enclosure 104 described above and reflector panels 214-3 and 214-4 could be mounted within a second enclosure 206 that is similar to the second enclosure 106 described above. As shown in FIG. 10D, blind mate (or quick-lock) connectors 262, 264 are mounted in two columns within the first and second enclosures 204, 206. It will be appreciated that the first and second enclosures 204, 206 may be essentially identical to the first and second enclosures 104, 106 that are described above, with appropriate modifications for the number and location of RF ports. Thus, further description of the enclosures 204, 206 will be omitted here. Moreover, while FIG. 10D illustrates each enclosure 204, 206 including two of the reflector panels 214, in other embodiments the first enclosure 204 may have three of the reflector panels mounted therein, and the second enclosure 206 may have the fourth reflector panel 214 mounted therein.

Figure 11:
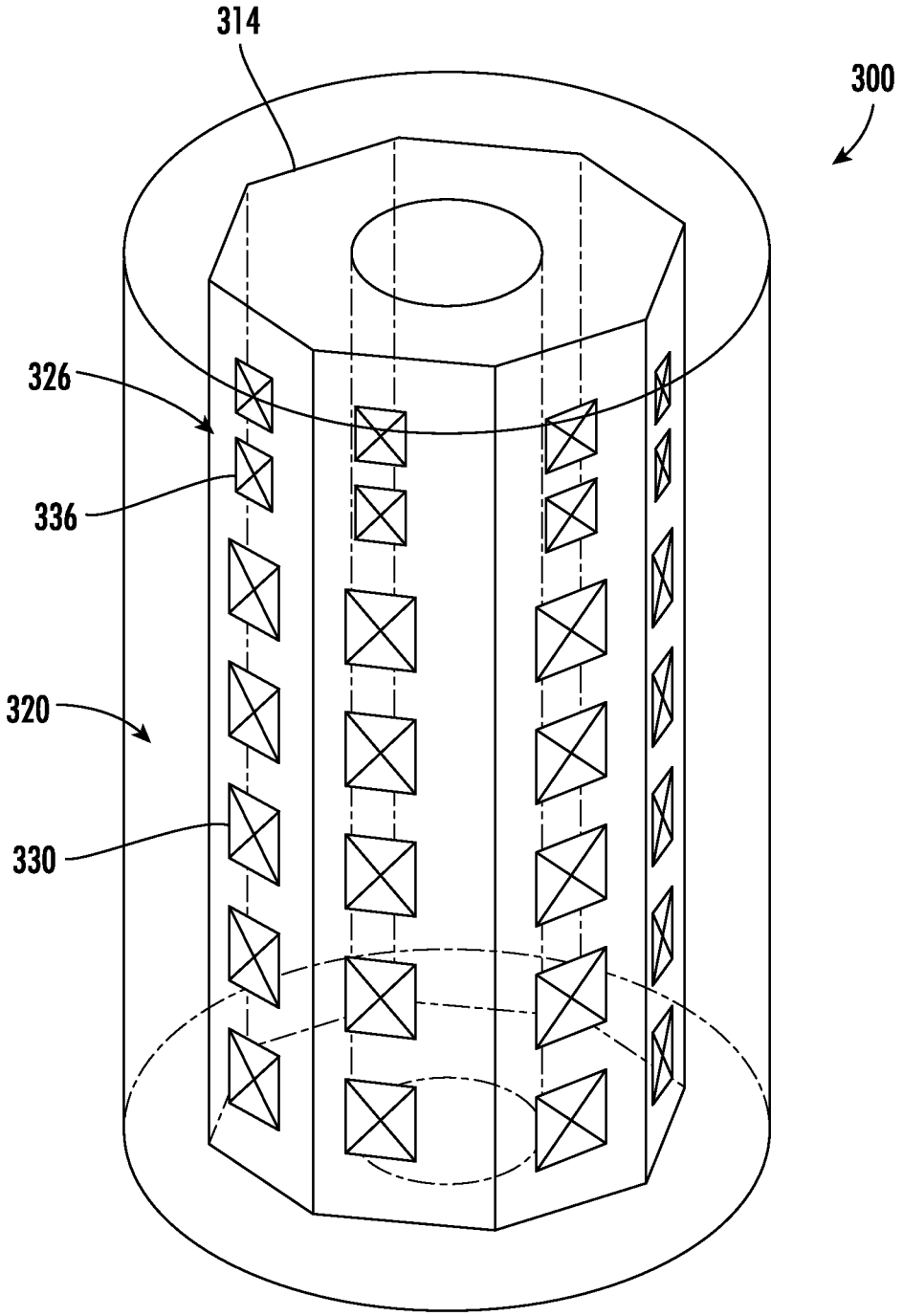
FIG. 11 is a schematic perspective view of the reflector panels and linear arrays of radiating elements of a snap-around metrocell antenna according to still further embodiments of the present invention.

FIG. 11 illustrates the reflector panels and linear arrays of radiating elements of a snap-around metrocell antenna 300 according to still further embodiments of the present invention. As shown in FIG. 11, the metrocell antenna 300 includes a total of eight reflector panels 314 that may define an octagonal transverse cross-section. The metrocell antenna 300 includes eight linear arrays 320 of mid-band radiating elements 330 (only four of which are visible in the view of FIG. 11) and eight linear arrays 326 of high-band radiating elements 336. In effect, the antenna 300 is similar to the antenna 200 described above with reference to FIGS. 10A-10D, but the antenna 300 doubles the number of linear arrays included in the antenna.

As with metrocell antenna 200, the linear arrays 320 and 326 on opposed reflector panels 314 may be commonly fed so that the antenna 300 includes four pairs of commonly fed mid-band linear arrays 320 that generate four peanut-shaped antenna beams at each of two polarizations and further includes four pairs of commonly fed high-band linear arrays 326 that generate four peanut-shaped antenna beams at each of two polarizations.

The antenna 300 of FIG. 11 may similarly be implemented as a snap-on antenna that includes first and second enclosures similar to the enclosures 104, 106 described above.

It is envisioned that metrocell antennas having a large number of RF ports may be implemented as snap-on antennas according to embodiments of the present invention. For example, in one specific embodiment a metrocell antenna may be provided that includes three reflector panels that define a triangle, with each reflector panel including two linear arrays of mid-band dual-polarized radiating elements, a linear array of 3.3-4.2 GHz dual-polarized radiating elements, and a linear array of 5.1-5.4 GHz dual-polarized radiating elements. Such an antenna may include sixteen RF ports. When such a large number of ports are required, RF ports will typically be mounted on the base plates of both the first and second enclosures, and a large number of blind-mate connections may be required.

While the metrocell antennas described above include RF ports in the form of RF connectors that are mounted in the base plates of the first and/or second enclosures of the antenna, it will be appreciated that other RF port implementations may alternatively or additionally be used. For example, "pigtails" in the form of connectorized jumper cables may extend through openings in the first and/or second enclosures and may act as the RF ports included in any of the above-described embodiments of the present invention.

In all of the above examples, duplexing of the transmit and receive channels is performed internal to the radio, so each port on the radio passes both transmit path and receive path RF signals. It will be appreciated, however, that in other embodiments duplexing may be performed in the antenna. Performing duplexing in the antenna may allow for setting the downtilt of the antenna beams separately for the transmit and receive paths.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some elements may not be to scale.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

That which is claimed is:

1. A metrocell antenna, comprising:

a first enclosure that has an elongated housing structure with a first front radome, wherein the first enclosure includes a first radio frequency ("RF") port;

a second enclosure that has an elongated housing structure with a second front radome, wherein the first and second enclosures are configured to attach to each other so that the first and second radomes cooperate to provide a combined front radome of the metrocell antenna, wherein, when attached, a rear wall of the first enclosure and a rear wall of the second enclosure define a longitudinally extending open center channel between and surrounded by the rear walls, and wherein the open center channel is sized and configured to surround a support pole; and a power divider having an input port that is coupled to the first RF port and that is mounted within the first enclosure, wherein a first output of the power divider is coupled to a first linear array of radiating elements that is mounted within the first enclosure and a second output of the power divider is coupled to a second linear array of radiating elements that is mounted within the second enclosure via a blind-mate or quick-lock connection that extends between the first and second enclosures.

2. The metrocell antenna of claim 1, wherein the metrocell antenna is configured to wrap around the support pole with the support pole positioned in the open center channel, and wherein rear wall segments of the respective rear walls of the first and second enclosures are parallel and abut at a location that is radially outward from the blind-mate or quick-lock connection and radially outward from the open center channel.

3. The metrocell antenna of claim 1, wherein the first enclosure is larger than the second enclosure, wherein the power divider includes a third output that is coupled to a third linear array of radiating elements that is mounted within the first enclosure, wherein the first enclosure comprises a reflector panel having a first panel segment behind the first linear array of radiating elements and a second panel segment behind the second linear array of radiating elements, and wherein the first panel segment is separated from the second panel segment by a longitudinally extending bend in the reflector so that the first panel segment is at a different angle from the second panel segment.

4. The metrocell antenna of claim 1, wherein the first through third linear arrays of radiating elements each extend vertically.

5. The metrocell antenna of claim 1, wherein the power divider includes a third output that is coupled to a third linear array of radiating elements,. wherein the third linear array of radiating elements is positioned within the first enclosure, and wherein the first, second and third linear arrays of radiating elements are configured to generate an antenna beam having a generally omnidirectional pattern in an azimuth plane.

6. The metrocell antenna of claim 1, wherein the first and second linear arrays of radiating elements each extend vertically, and wherein the first enclosure has a generally C-shaped transverse cross-section.

7. The metrocell antenna of claim 1, wherein the first enclosure is configured to be mounted to the support pole, and the second enclosure is configured to be mounted to the first enclosure.

8. The metrocell antenna of claim 1, further comprising at least first, second and third reflector panels, wherein the first reflector panel is mounted in the first enclosure and the second reflector panel is mounted within the second enclosure, wherein the first linear array of radiating elements extends outwardly from the first reflector panel and the second linear array of radiating elements extends outwardly from the second reflector panel.

9. The metrocell antenna of claim 1, wherein the housing structures of the first and second enclosures of the metrocell antenna have a common length and, when attached to each other, define a generally cylindrical shape of the metrocell antenna.

10. The metrocell antenna of claim 1, wherein the blind-mate or quick-lock connection comprises a capacitively-coupled blind-mate connection.

11. The metrocell antenna of claim 1, wherein the blind-mate or quick-lock connection comprises a capacitively-coupled blind-mate connector that projects inward toward a rear wall segment of the first enclosure or the second enclosure adjacent the open center channel.

12. The metrocell antenna of claim 1, wherein the first and second enclosures are attached to define a two-piece housing structure.

13. The metrocell antenna of claim 1, wherein the first enclosure has a generally C-shaped transverse cross-section and is matably, slidably coupled to the second enclosure.

14. The metrocell antenna of claim 1, wherein the first enclosure and the second enclosure are configured to slidably engage to connect the blind-mate or quick lock connection and to form the open center channel whereby the first and second enclosures define a substantially cylindrical two-piece housing with the first and second linear arrays of radiating elements of the metrocell antenna.

15. The metrocell antenna of claim 1, wherein the first enclosure includes more reflector panels than the second enclosure.

16. The metrocell antenna of claim 1, wherein one of the first and second enclosures includes a total of two reflector panels and the other of first and second enclosures includes a single reflector panel.

17. The metrocell antenna of claim 1, wherein the first and second linear arrays are commonly connected to the first RF port and are mounted on first and second reflector panels, respectively, and wherein the first and second reflector panels face in different directions when the metrocell antenna is mounted for use.

18. The metrocell antenna of claim 1, wherein the blind-mate or quick-lock connection comprises a plurality of blind-mate or quick-lock connectors that provide respective electrical connections between the first enclosure and the second enclosure, and wherein the plurality of blind-mate or quick-lock connectors project outward from one or both of the rear walls of the first and second enclosures, adjacent the open center channel.

19. The metrocell antenna of claim 1, wherein the rear wall of the first enclosure and the rear wall of the second enclosure have a radially and longitudinally extending recess, wherein the recess in the rear wall of the first enclosure faces the recess in the rear wall of the second enclosure, on opposing sides of the open channel, forming at least part of the open center channel.

20. The metrocell antenna of claim 19, wherein the recess in the first enclosure is deeper than the recess in the second enclosure.

21. A metrocell antenna, comprising:

a first enclosure that has an elongated housing structure with a front radome and a rear wall, wherein the first enclosure includes a first radio frequency ("RF") port;

a second enclosure that has an elongated housing structure with a front radome and a rear wall, wherein the first and second enclosures are configured to attach to each other so that the front radome of the first enclosure cooperates with the front radome of the second enclosure to together provide a front radome of the metrocell antenna that extends 360 degrees, wherein, when attached, the rear wall of the first enclosure and the rear wall of the second enclosure define a longitudinally extending open center channel between and surrounded by the rear walls, and wherein the open center channel is sized and configured to surround a support pole;

a power divider having an input port that is coupled to the first RF port and is mounted within the first enclosure; and a plurality of blind-mate or quick-lock connectors that projects inward from the rear walls of the first and second enclosures, wherein a first output of the power divider is coupled to a first linear array of radiating elements that is mounted within the first enclosure and a second output of the power divider is coupled to a second linear array of radiating elements that is mounted within the second enclosure via the blind-mate or quick lock connection.

22. The metrocell antenna of claim 21, wherein rear wall segments of each of the rear wall of the first enclosure and the rear wall of the second enclosure are parallel and abut at a location that is radially outward from the blind-mate or quick-lock connection and from the open center channel, and wherein the rear wall of the first enclosure and the rear wall of the second enclosure have a radially and longitudinally extending recess, wherein the recess in the rear wall of the first enclosure faces the recess in the rear wall of the second enclosure, on opposing sides of the open channel, forming at least part of the open center channel.

23. The metrocell antenna of claim 22, wherein the recess in the first enclosure is deeper than the recess in the second enclosure.

24. The metrocell antenna of claim 21, wherein the front radome of the first enclosure extends circumferentially in a range of 180-270 degrees, and wherein the front radome of the second enclosure extends circumferentially in a range of 180-90 degrees.

25. The metrocell antenna of claim 21, wherein the front radome of the first enclosure extends circumferentially 180 degrees, and wherein the front radome of the second enclosure extends circumferentially 180 degrees.

* * * * *